US005205642A

United States Patent [19]

Kai et al.

[11] Patent Number: 5,205,642

[45] Date of Patent: Apr. 27, 1993

[54] MIRROR AND LAMP ASSEMBLY

[75] Inventors: Kenzo Kai, Numazu; Mitsuo Horikoshi, Mishima, both of Japan

[73] Assignee: Ushio Denki, Tokyo, Japan

[21] Appl. No.: 784,189

[22] Filed: Oct. 29, 1991

[30] Foreign Application Priority Data

Oct. 30, 1990 [JP] Japan ..... 2-290789
Mar. 11, 1991 [JP] Japan ..... 3-69430

[51] Int. Cl.[5] ..... F21V 7/00

[52] U.S. Cl. ..... 362/341; 362/264; 362/265; 313/634

[58] Field of Search ..... 439/182, 206, 612; 313/113, 634; 362/341, 263, 264, 265

[56] References Cited

U.S. PATENT DOCUMENTS

| | | | |
|---|---|---|---|
| 3,648,045 | 3/1972 | Le Vantine et al. | 362/265 |
| 3,700,881 | 10/1972 | Slomski | 362/265 |
| 4,163,277 | 7/1979 | Altman | 362/263 |
| 4,290,097 | 9/1981 | Block et al. | 362/264 |
| 4,423,348 | 12/1983 | Greiler | 362/264 |
| 4,423,471 | 12/1983 | Gordin et al. | 362/264 |
| 4,564,783 | 1/1986 | Krieg et al. | 313/113 |

FOREIGN PATENT DOCUMENTS

| | | |
|---|---|---|
| 51-39958 | 10/1976 | Japan . |
| 57-78704 | 5/1982 | Japan . |
| 63-13524 | 3/1988 | Japan . |

*Primary Examiner*—Ira S. Lazarus
*Assistant Examiner*—Alan B. Cariaso
*Attorney, Agent, or Firm*—Armstrong, Westerman, Hattori, McLeland & Naughton

[57] ABSTRACT

In a lamp assembly according to the present invention, a double ended lamp is securely supported in such a way that the one end of said lamp is fixed to a cap or a mirror and the other end of said lamp is fixed to a power supply member. The power supply member located in front of the mirror is made of a metal member of a higher rigidity. A flexible covered wire is secured with an adhesive, so that it may be located outside the periphery of the mirror and a connection portion of the metal member to the covered wire cannot protrude from a contour of the edge of the mirror. Therefore, the lamp assembly can be easily handled. In addition, the inclined bottom surface of a ventilating cutout in a cap ensures that the lamp can be cooled satisfactorily, leading to a long life of the lamp.

2 Claims, 3 Drawing Sheets

MIRROR AND LAMP ASSEMBLY

BACKGROUND OF THE INVENTION

1. Field of the Invention

This invention relates to a mirror for use in combination with a lamp, and particularly, to a mirror made of a glass.

2. Description of the Prior Art

When a lamp is used in a various optical apparatus, a lamp only may be incorporated into an optical system in the optical apparatus in some cases, or a lamp assembly composed of a lamp, a mirror and other parts by securing of them with an adhesive or by another means may be incorporated into an optical system in the optical apparatus in some cases. The handling in the latter case is easier than that in the former case, and therefore, the lamp assembly has been used in a projector or a small-sized optical apparatus. The assembly, however, is generally provided with a positioning mechanism corresponding to a mechanism in the optical apparatus, because said assembly is required to be set in a predetermined position within said apparatus. FIG. 6 illustrates a lamp assembly comprising a double ended discharge lamp and a glass mirror, which are secured to each other with an adhesive. In this lamp assembly, the mirror 300 comprises a cylindrical portion 301 having a rectangular section, in which the one end of the discharge lamp 304 is secured with an adhesive 305, and an edge 302 having a projection 303. When this assembly is to be incorporated into and positioned in an optical apparatus, the cylindrical portion 301 and the projection 303 or the edge 302 are used for positioning. However, there are disadvantages that the handling of a covered wire 306 connected to the other end of the discharge lamp 304 is inconvenient and that the one end of the discharge lamp 304 is difficult to cool.

SUMMARY OF THE INVENTION

The present invention provides a lamp assembly comprising:

a mirror which includes an edge having a positioning mechanism for mounting to another apparatus, a cylindrical portion into which a double ended lamp can be inserted at a distance spaced apart from an inner surface of the cylindrical portion, and a central portion formed into a reflector surface, these portions being integrally formed;

a cap secured to an outer surface of the cylindrical portion and having a ventilating cutout, the bottom surface of which is inclined to facilitate air flow toward said lamp;

said double ended lamp, the one end of which is secured to the inner surface of the cylindrical portion with an adhesive in such a way that said adhesive is partially filled into the space between said end and said inner surface and air flow can be permitted through said space;

a metal member of a larger rigidity, the one end of which is fixed to the edge and to which a lead bar extending from the other end of the lamp is connected; and covered wires connected to another lead bar extending from the one end of the lamp and to the metal member, respectively.

In the assembly having such a construction, the following advantages can be achieved: The double ended lamp can be supported securely, and the handling of the covered wires is easy. Further, the bulb and the both ends of the lamp can be cooled satisfactorily.

DESCRIPTION OF THE PREFERRED EMBODIMENT

Figure 1A:
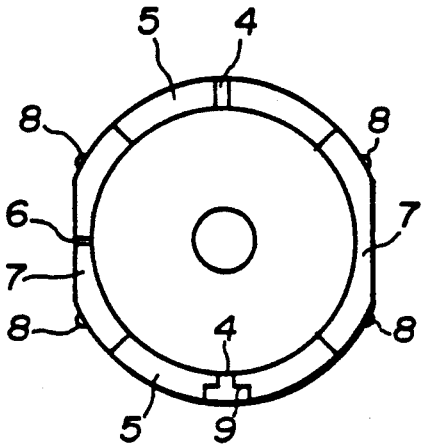
FIGS. 1*a* and 1*b* are plane and side views of one embodiment of a mirror used in the present invention, respectively.
Figure 1B:
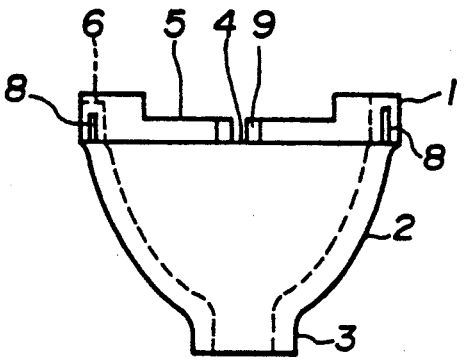

FIGS. 1*a* and 1*b* are plane and side views of a mirror made of a glass, respectively. Referring to FIGS. 1*a* and 1*b*, the mirror comprises an edge indicated by reference numeral 1, a central portion indicated by 2, and a cylindrical portion designated by 3. A front end face of the edge 1 is formed into a stepped structure which comprises a lower portion 5 having a lead groove 4, and a higher portion 7 having a positioning groove 6. A reflecting film is provided on an inner surface of the central portion 2. A positioning projection denoted by reference numeral 8 may be provided if necessary. Reference numeral 9 indicates a thinner wall portion which is formed by reducing the wall thickness of the edge 1 around the lead groove 4 and which defines a recess extending inwardly from the outside. When the mirror is applied as a mirror by itself or a lamp assembly, grasping a larger diameter portion is better for handling and therefore, an outer surface of the edge may be either frosted or formed into a finely rugged surface in order to make slipping difficult. If a fine ruggedness is provided on an outer surface of the cylindrical portion, a cap, when it is to be fixed thereto with an adhesive, can be securely fixed, because of a larger bonded area.

Figure 2A:
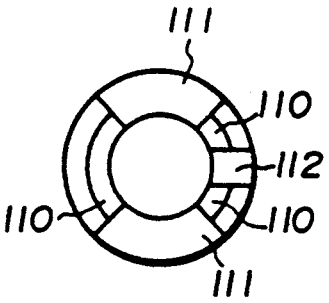
FIGS. 2*a*, 2*b* and 2*c* are plane, front and side views of one embodiment of a cap used in the present invention, respectively.
Figure 2B:
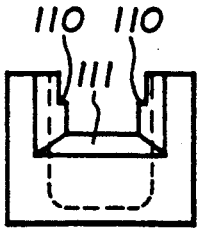
Figure 2C:
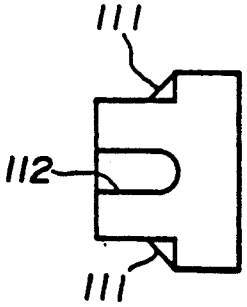

FIGS. 2*a*, 2*b* and 2*c* are plane, front and side views of a cap made of alumina, respectively. Referring to FIGS. 2*a*, 2*b* and 2*c*, the cap includes a step indicated by 110 for supporting the cylindrical portion of the mirror, and a ventilating cutout indicated by 111. The bottom surface of the cutout 111 is inclined to facilitate the flowing of a cooling air toward the lamp. Reference numeral 112 designates a cutout for drawing-out a covered wire. Thus, when the mirror shown in FIGS. 1*a* and 1*b* is secured to the cap shown in FIGS. 2*a*, 2*b* and 2*c* with the cylindrical portion 3 received onto the step 110 by use of an adhesive, the space surrounded by central portion 2 communicates with an outside space of the cap through the ventilating cutout 111.

Figure 3:
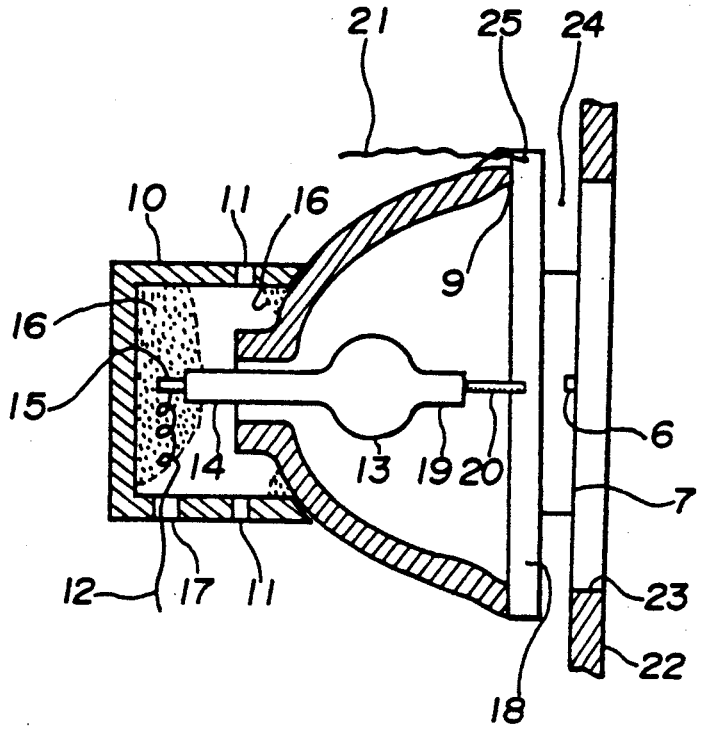
FIG. 3 is a schematic sectional view of a lamp assembly according to the present invention.

FIG. 3 is a schematic sectional view illustrating a construction of a lamp assembly according to one embodiment of the present invention.

Referring to FIG. 3, a cap 10 has a ventilating hole 11 and is secured to the mirror with an adhesive 16. The cap 10 may be made of the material such as metal and ceramics. A covered wire indicated by 12 is connected to an external lead bar 15 extending from the one end 14 of a discharge lamp 13. The one end 14 is secured to a bottom of the cap 10 with the adhesive 16, and the covered wire 12 is drawn out through the ventilating hole 11 or an insertion hole 17. A metal member 18 having a high rigidity is placed to extend between the lead grooves 4, and another external lead bar 20 extending from the other end 19 of the discharge lamp 13 is connected directly or indirectly to the metal member 18. The metal member 18 is fixed at the lead grooves 4 by use of an adhesive or by another means and eventually, the discharge lamp 13 is fixed in such a manner that it is supported at its opposite ends. Therefore, the discharged lamp is very stable.

A covered wire indicated by 21 is connected to the one end of the metal member 18 located in the recess surrounded by the thinner wall portion 9. The covered wire 21 is received into the recess and is secured therein with an adhesive covering a connection portion 25, so that it cannot project from the edge 1 of the mirror. Thus, the lamp assembly can be handled very easily. Reference numeral 22 designates a assembly mounting plate in an optical apparatus. The lamp assembly is positioned in alignment with an aperture 23 provided in the assembly mounting plate 22. In this case, a clearance 24 produced between the mirror and the assembly mounting plate 22 communicates with the ventilating hole 11, because the discharge lamp 13 is spaced apart from the cylindrical portion 3. Therefore, the discharge lamp 13 can be cooled satisfactorily.

Figure 4:
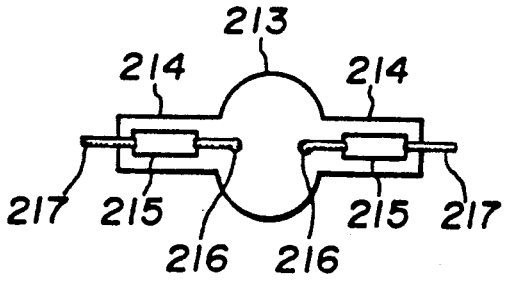
FIG. 4 illustrates another embodiment of a lamp used in the present invention.

FIG. 4 illustrates a double ended mixed-metal discharge lamp containing mercury and rare earth metal. In FIG. 4, this lamp has a light emitting tube indicated by 213 and a metal molybdenum foil 215 air-tightly embedded in each of its both ends. An electrode 216 and a lead bar 217 are connected to each of the foils 215. This discharge lamp is lighted at a power consumption of about 400 W with the aid of the A.C. power source. The lamp is very useful for stage illumination because of a good color rendition thereof, when it is used as a light source assembled with the mirror.

Figure 5:
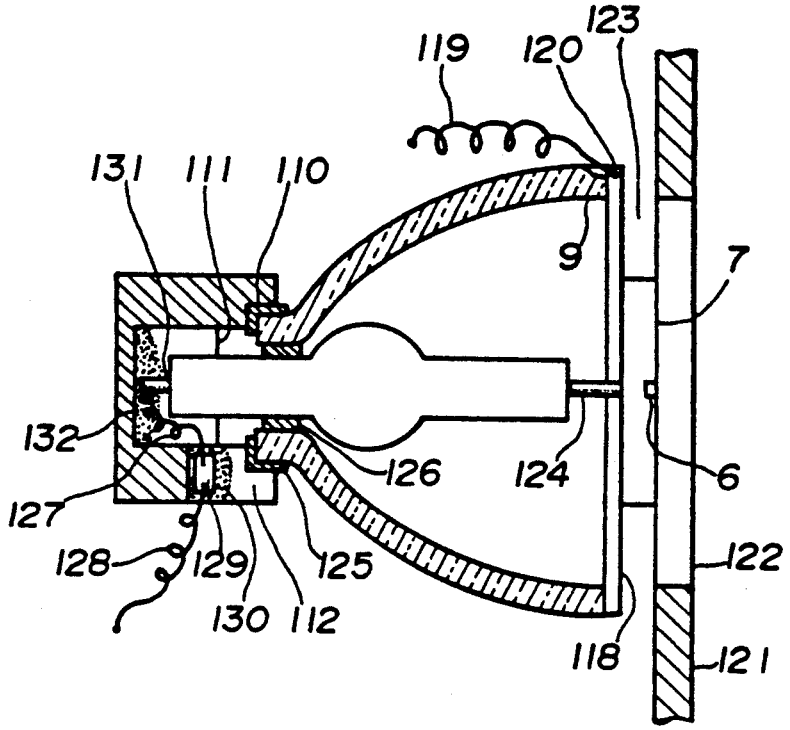
FIG. 5 illustrates a lamp assembly according to another embodiment of the present invention.
Figure 6:
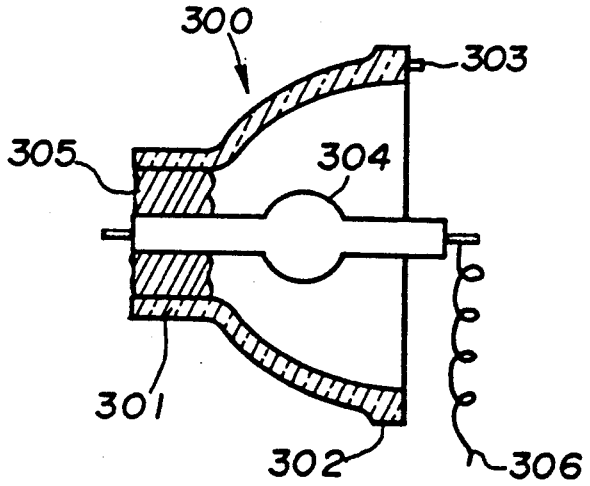
FIG. 6 is an illustration of one example of the prior art lamp assembly.

FIG. 5 illustrates a lamp assembly according to another embodiment of the present invention. In FIG. 5, a metal member 118 having a high rigidity is placed to extend between the lead grooves 4 in the edge of the mirror. The metal member 118 is made of copper and formed into a plate-like shape and secured in the groove with an adhesive at the one end closer to the thinner wall portion 9. The other end of the metal member is not fixed with the adhesive, because an increase in dimensions due to a thermal expansion of the metal member is anticipated. Another covered wire 119 is connected with the metal member 118 at the recess defined by the thinner wall portion 9 of the edge, and a connection portion 120 thereof is also embedded in an adhesive which is not shown In FIG. 5. In this case, the covered wire 119 at the connection portion 120 is secured with the adhesive in the recess, so that it cannot protrude from a contour of the edge. Reference numeral 121 denotes a lamp assembly mounting plate in an optical apparatus, and reference numeral 122 denotes an aperture in the lamp assembly mounting plate 121. In this case, there is a clearance 123 produced between the mirror and the mounting plate 121. Another lead bar 124 of the lamp is connected to the metal member 118, so that the supporting of the lamp and the supplying of a power can be achieved.

Reference numeral 125 designates an adhesive used to bond the cap and the cylindrical portion 3 of the mirror to each other. Preferably, the adhesive 125 is filled sufficiently so that the entire outer surface of the cylindrical portion may be bonded to the step 110 of the cap. Reference 126 designates an adhesive filled into a clearance between an outer surface of the one end of the lamp and the inner surface of the cylindrical portion of the mirror. The adhesive 126 is partially filled into the clearance with some space being left, so that the ventilating cutout 111 permits the one end of the lamp to contact with the atmosphere outside the cap. As a result of such construction, the cutout 111 may be put into communication with the clearance 123. Thus, both of the opposite ends and the light emitting tube 213 of the lamp can be cooled satisfactorily, leading to the decrease of the lamp damage.

Reference numeral 127 designates a lead wire connected to the one lead bar 131. Reference numeral 128 denotes a covered wire which is connected through a crimp-type terminal 129 to the lead wire 127. The crimp-type terminal 129 is secured in a cutout 112 with an adhesive 130. The one lead bar 131 and the lead wire 127, after being interconnected, are also secured with an adhesive 132. Thus, the lamp is supported with a stability at three locations corresponding to the bottom of the cap, the metal member and the cylindrical portion of the mirror. In addition, the lead wire 127 and the covered wire 128 are fixed at the location corresponding to the cutout 112, so that an external force cannot be transmitted to the one end of the lamp.

What is claimed:

1. A lamp assembly comprising:

a mirror which includes a front edge having an engaging mechanism for mounting to another apparatus, a cylindrical portion into which a double ended lamp can be inserted and positioned at a distance spaced apart from an inner surface of the cylindrical portion, and a central portion formed into a reflector surface, said mirror being integrally formed;

a cap secured to said mirror to cover the cylindrical portion and having at least one of a ventilating hole and a ventilating cutout;

said double ended lamp secured at one end to said cap with an adhesive, wherein said front edge is provided, at a front end face, with lower portions at two places, each having a lead groove, and a higher portion having a positioning groove and a wall of said front edge around at least one of said lead grooves is formed with a thickness reduced inwardly from outside; and a rigid metal member placed to extend between the lead grooves, a covered wire connected to said metal member in a recess of the thinner wall portion of said front edge, another covered wire connected to an external lead bar extending from the one end of said lamp, and another external lead bar extending from another end of said lamp connected to said metal member.

2. A lamp assembly comprising:

a mirror which incorporates a front edge having a positioning mechanism for mounting to another apparatus, a cylindrical portion into which a double ended lamp can be inserted and positioned at a distance spaced apart from an inner surface of the cylindrical portion, and a central portion formed into a reflector surface, said mirror being integrally formed;

a cap secured to an outer surface of the cylindrical portion and having a ventilating cutout, a bottom surface which is inclined to facilitate air flow toward the lamp;

said double ended lamp, one end of which is secured to the inner surface of the cylindrical portion with an adhesive such that the adhesive is partially filled into a space between the one end and the inner surface and air flow can be permitted through said space, said edge is provided, at a front end face, with lower portions at two places, each having a lead groove, and a higher portion having a positioning groove and a wall of said front edge around at least one of said leads grooves is formed with a thickness reduced inwardly from outside; and a rigid metal member placed to extend between the lead grooves, a covered wire connected to said metal member in a recess of the thinner wall portion of said front edge, another covered wire connected to an external lead bar extending from the one end of said lamp, and another external lead bar extending from another end of said lamp connected to said metal member.

* * * * *